US009428941B1

(12) United States Patent
Yang

(10) Patent No.: US 9,428,941 B1
(45) Date of Patent: Aug. 30, 2016

(54) PADLOCK WITH A REMOVABLE SHACKLE

(71) Applicant: Yao-Kun Yang, Changhua County (TW)

(72) Inventor: Yao-Kun Yang, Changhua County (TW)

( * ) Notice: Subject to any disclaimer, the term of this patent is extended or adjusted under 35 U.S.C. 154(b) by 0 days.

(21) Appl. No.: 14/860,714

(22) Filed: Sep. 22, 2015

(51) Int. Cl.

| | |
|---|---|
| ***E05B 67/06*** | (2006.01) |
| ***E05B 67/02*** | (2006.01) |
| ***E05B 67/00*** | (2006.01) |
| ***E05B 37/00*** | (2006.01) |
| ***E05B 67/26*** | (2006.01) |

(52) U.S. Cl.
CPC ..... *E05B 67/063* (2013.01); *E05B 37/0068* (2013.01); *E05B 67/003* (2013.01); *E05B 67/02* (2013.01); *E05B 67/26* (2013.01)

(58) Field of Classification Search
CPC ..... E05B 67/24; E05B 67/26; E05B 67/063; E05B 63/0056; E05B 67/003; E05B 67/02; E05B 67/22; E05B 37/0068; Y10T 70/459; Y10T 70/454; Y10T 70/426; Y10T 70/491; Y10T 70/461; Y10T 70/435; Y10T 70/483
USPC ..... 70/26, 39, 38 A–38 C
See application file for complete search history.

(56) References Cited

U.S. PATENT DOCUMENTS

| | | | | | |
|---|---|---|---|---|---|
| 539,650 | A * | 5/1895 | Searle | E05B 75/00 | 70/15 |
| 957,033 | A * | 5/1910 | DeBruyker | E05B 67/24 | 70/38 A |
| 3,626,729 | A * | 12/1971 | Fane et al. | E05B 67/24 | 70/18 |
| 3,855,824 | A * | 12/1974 | Falk | E05B 63/121 | 70/38 A |
| 4,112,715 | A * | 9/1978 | Uyeda | E05B 67/24 | 70/38 A |
| 4,183,566 | A * | 1/1980 | Yates | G09F 3/0358 | 292/317 |
| 4,241,594 | A * | 12/1980 | Miller | E05B 67/24 | 70/369 |
| 4,290,280 | A * | 9/1981 | Yun | E05B 67/24 | 70/38 A |
| 4,838,051 | A * | 6/1989 | Yang | E05B 27/086 | 70/358 |
| 5,377,511 | A * | 1/1995 | Meckbach | E05B 67/063 | 70/371 |
| 5,746,075 | A * | 5/1998 | Yang | E05B 37/025 | 70/25 |
| 5,787,736 | A * | 8/1998 | Ling | E05B 37/025 | 70/26 |
| 6,101,852 | A * | 8/2000 | Steinbach | E05B 67/06 | 70/38 A |
| 6,766,673 | B2 * | 7/2004 | Gast | E05B 67/06 | 70/26 |
| 6,813,913 | B2 * | 11/2004 | Watts | E05B 67/24 | 70/20 |
| 7,036,344 | B2 * | 5/2006 | Gast | E05B 67/06 | 70/26 |
| 7,246,511 | B1 * | 7/2007 | Zhu | E05B 67/003 | 42/70.11 |
| 7,251,965 | B2 * | 8/2007 | Yu | E05B 35/105 | 70/21 |
| 7,631,524 | B2 * | 12/2009 | Araujo | E05B 35/105 | 70/25 |
| 7,856,855 | B2 * | 12/2010 | Fantl | E05B 63/0056 | 70/38 A |
| 8,151,608 | B2 * | 4/2012 | Fisher | E05B 19/0005 | 70/24 |
| 8,806,905 | B2 * | 8/2014 | Burmesch | E05B 67/18 | 70/371 |
| 8,904,833 | B1 * | 12/2014 | Liu | E05B 67/24 | 70/368 |
| 8,919,157 | B2 * | 12/2014 | Fantl | E05B 63/0056 | 70/38 A |
| 2002/0007654 | A1 * | 1/2002 | Watts | E05B 67/24 | 70/38 A |

* cited by examiner

*Primary Examiner* — Suzanne Barrett

(57) ABSTRACT

A padlock comprises a housing, a shackle, a locking member, and a limiting set. The housing has a front cover and a rear cover which is pivoted at the front cover. The rear cover has a sliding groove. The rear cover which corresponds to the sliding groove has a through hole and a locking hole. A penetrating groove is formed at the sliding groove. The shackle has a pivoting portion which passes through the through hole and moved toward the cavity. The locking member is slidably arranged in the sliding groove and limited by or separated from the locking portion of the shackle. The limiting set has a limiting member and a releasing member. The limiting member includes an entry slot, an embedded end, and an inclined surface. The limiting member is slidably arranged in the sliding groove. The releasing member is slidably arranged in the penetrating groove.

8 Claims, 9 Drawing Sheets

PADLOCK WITH A REMOVABLE SHACKLE

BACKGROUND OF THE INVENTION

1. Field of the Invention

The present invention relates to a padlock, and especially relates to a padlock with a removable shackle.

2. Description of Related Art

The locking devices are various and have different sizes and structures to provide for the users to select. The shackle of the locking device which is for limiting or releasing provides to lock the objects. Since the objects have different sizes and shapes, the shackles also have different sizes and shapes which corresponds to the objects. Please reference to Taiwanese patent no. M401045 (A Piezoelectric Sensing Padlock) and M494820 (Sensing Padlock).

In order to correspond to the objects with bigger sizes, a flexible shackle which is made by a steel rope is disclosed, please reference to Taiwanese patent no. 4024828 and 507808. The shackle made by the flexible steel rope is capable for applying to the objects with various sizes.

However, the conventional shackle is the single size and standard and designed to be a limiting structure which is unable to be removed. Therefore, the shackle cannot be replaced to correspond to objects with the different sizes and shapes. The applicability is limited.

Because the conventional shackle is the single size and standard and designed to be a limiting structure which is unable to be removed, and the shackle cannot be replaced to correspond to objects with the different sizes and shapes so that the applicability is limited. The consumers need to buy many padlocks whose shackles have different sizes and shapes to correspond to the objects with different sizes and shapes. The money is wasted and the padlocks are hard to be accepted by the consumers.

In view of the foregoing circumstances, the inventor has invested a lot of time to study the relevant knowledge, compare the pros and cons, research and develop related products. After quite many experiments and tests, the "padlock with a removable shackle" of this invention is eventually launched to improve the foregoing shortcomings, to meet the public use.

SUMMARY OF THE INVENTION

The conventional padlock has the shackle with only one standard size and the applicability is limited. The user needs to buy many padlocks whose shackles have various standards to resulting in wasting money. It will be harder and harder accepted by consumers in the market. The above mentioned problems need to be solved.

An object of this invention is providing a padlock with a removable shackle. The shackle may be removed and then replaced by another one with different size or shape. It is capable for applying to the objects with various sizes. The applicability is much more wider.

Another object of this invention is providing a padlock with a removable shackle. The consumers do not need to buy the shackles with different standards to cooperate with different objects to prevent from wasting money and further the padlock may be accepted by the consumers much more.

In order to achieve above mentioned effects, a padlock with a removable shackle is provided. The padlock may comprise a housing, having a front cover and a rear cover, the rear cover is pivoted at the front cover and capable for pivotably opening and closing relative to the front cover, a cavity is defined by the front cover and the rear cover while they are closed together, one side of the rear cover corresponding to the front cover has a sliding groove, an outer wall of one side of the rear cover corresponding to the sliding groove has a through hole and a locking hole which are communicated with the sliding groove, a penetrating groove is formed at a side wall of the sliding groove connected with the cavity and the penetrating groove is fluidly communicated with the sliding groove; a shackle, having a pivoting portion and a locking portion connected with each other, the pivoting portion is passing through the through hole and moved toward the cavity, and the locking portion is separated from or locked at the housing through moving the pivoting portion; a locking member, having a hook portion and a locking end, the locking member is slidably arranged in the sliding groove, and the locking end is limited by or separated from the locking portion of the shackle; and a limiting set, having a limiting member and a releasing member, the limiting member includes an entry slot, an embedded end, and an inclined surface, the inclined surface is connected with a side wall of the entry slot, the limiting member is slidably arranged in the sliding groove, the embedded end is limited by or separated from the pivoting portion of the shackle, a pushing inclined plane is arranged at the releasing member corresponding to the inclined surface, the releasing member is slidably arranged in the penetrating groove and inserted into the entry slot of the limiting member; wherein the pushing inclined plane is against the inclined surface and then the limiting member is pushed by the pushing inclined plane to separate from or limit the pivoting portion.

The padlock further comprises a spring. The spring is located in the sliding groove and arranged between the locking member and the limiting member, and two ends of the spring are respectively against the locking member and the limiting member.

In some embodiments, the housing further has a covering plate, the sliding groove is covered by the covering plate, the covering plate has a limiting groove, one side of the locking member corresponding to an opening of the sliding groove has a neck portion and a stirring portion, the neck portion is engaged with the limiting groove, and the stirring portion is exposed outside the covering plate.

In some embodiments, the rear cover has at least one arm, a combination lock set is arranged at the front cover and located in the cavity, the combination lock set has at least one block corresponding to the arm, and the combination lock set controls the arm to lock or unlock the block.

In some embodiments, the pivoting portion of the shackle has a limiting annular groove, the embedded end of the limiting member is engaged with the limiting annular groove, the locking portion has a locking annular groove, and the locking end of the locking member is engaged with the locking annular groove.

In some embodiments, the shackle is a flexible steel rope.

The various objectives and advantages of the present invention will be more readily understood from the following detailed description when read in conjunction with the appended drawing.

DETAILED DESCRIPTION OF THE INVENTION

Figure 1:
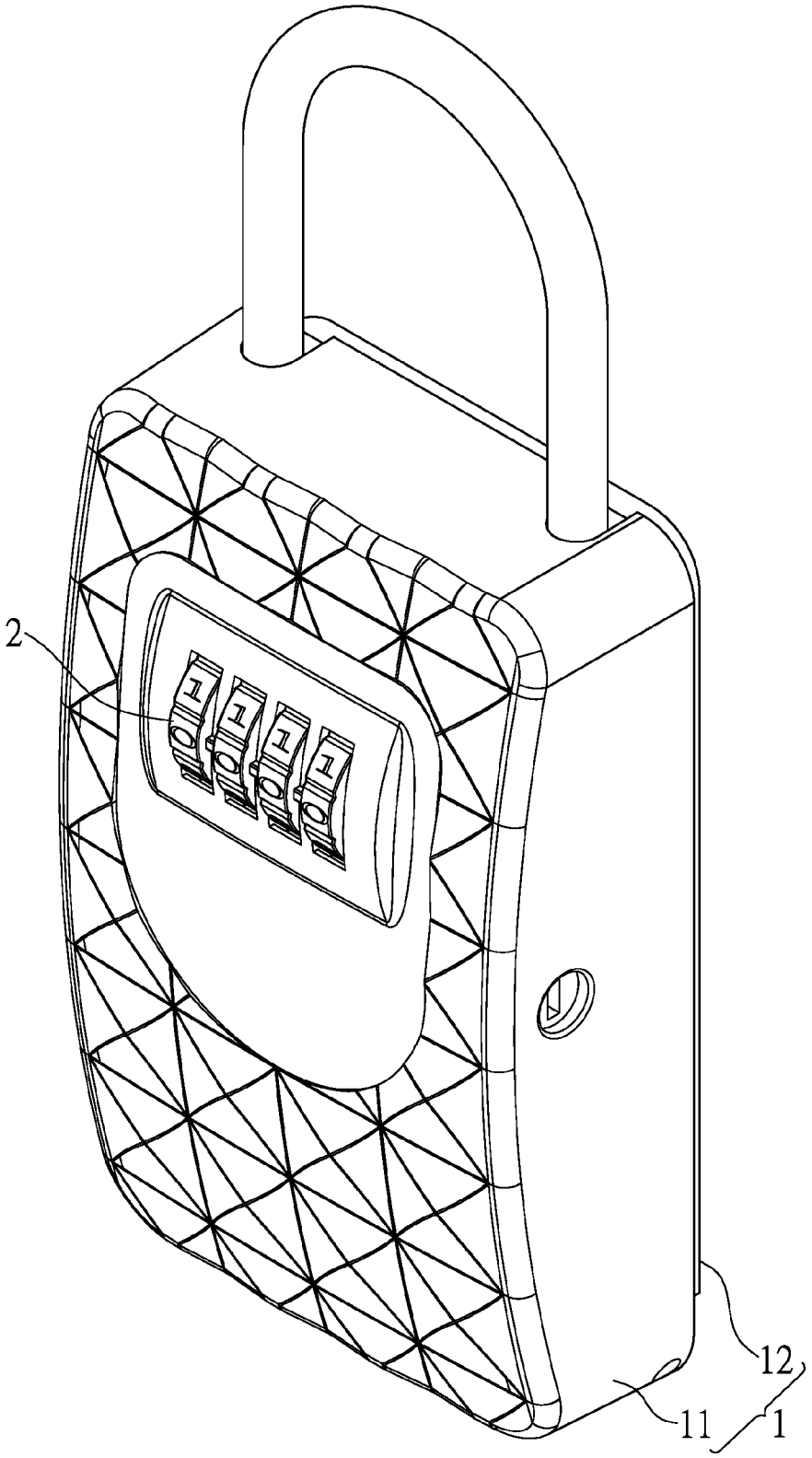
FIG. 1 is a perspective view of a padlock with a removable shackle of the present invention.

To describe clearly that the present invention achieves the foregoing objective and function, the technical features and desired function are described with reference to a preferred embodiment and accompanying drawings.

Please reference to FIGS. 1 to 4, a padlock with a removable shackle of the present invention may comprise a housing 1, a shackle 3, a locking member 4, and a limiting set 5. The housing 1 has a front cover 11 and a rear cover 12. The rear cover 12 is pivoted at the front cover 11 and capable for pivotably opening and closing relative to the front cover 11. A cavity 13 is defined by the front cover 11 and the rear cover 12 while they are closed together. One side of the rear cover 12 which is corresponding to the front cover 11 has a sliding groove 122. An outer wall of one side of the rear cover 12 which is corresponding to the sliding groove 122 has a through hole 123 and a locking hole 124 which are communicated with the sliding groove 122. A penetrating groove 125 is formed at a side wall of the sliding groove 122 which is connected with the cavity 13 and the penetrating groove 125 is fluidly communicated with the sliding groove 122. The shackle 3 has a pivoting portion 31 and a locking portion 32 which are connected with each other. The pivoting portion 31 is passing through the through hole 123 and moved toward the cavity 13. The locking portion 32 is separated from or locked at the housing 1 through moving the pivoting portion 31. The locking member 4 has a hook portion 41 and a locking end 42. The locking member 4 is slidably arranged in the sliding groove 122. The locking end 42 is limited by or separated from the locking portion 32 of the shackle 3. The limiting set 5 has a limiting member 51 and a releasing member 52. The limiting member 51 includes an entry slot 511, an embedded end 512, and an inclined surface 513. The inclined surface 513 is connected with a side wall of the entry slot 511. The limiting member 51 is slidably arranged in the sliding groove 122. The embedded end 512 is limited by or separated from the pivoting portion 31 of the shackle 3. A pushing inclined plane 521 is arranged at the releasing member 52 and corresponding to the inclined surface 513. The releasing member 52 is slidably arranged in the penetrating groove 125 and inserted into the entry slot 511 of the limiting member 51. Therefore, the pushing inclined plane 521 is against the inclined surface 513 and then the limiting member 51 is pushed by the pushing inclined plane 521 to separate from or limit the pivoting portion 31. (The above mentioned embodiment is the main skill feature of this invention and corresponds to the claim 1 of this invention to understand the objective and embodiments of this invention in detail. And the skill features of the depending claims are for describing the claim 1 in detail or adding more skill features, but not limited thereto. It should be known that the claim 1 is not necessary to include the skill features of the depending claims.)

In FIGS. 1 to 4, the padlock of the present invention may further comprise a spring 7. The spring 7 is located in the sliding groove 122 and arranged between the locking member 4 and the limiting member 51. Two ends of the spring 7 are respectively against the locking member 4 and the limiting member 51. The housing 1 may further have a covering plate 8. The sliding groove 122 is covered by the covering plate 8. The covering plate 8 has a limiting groove 81. One side of the locking member 4 which is corresponding to an opening of the sliding groove 122 has a neck portion 43 and a stirring portion 44. The neck portion 43 is engaged with the limiting groove 81 and the stirring portion 44 is exposed outside the covering plate 8. The rear cover 12 has at least one arm 121. A lock set 2 is arranged at the front cover 11 and located in the cavity 13. The lock set 2 has at least one block 22 which is corresponding to the arm 121. The lock set 2 may control the arm 121 to lock or unlock the block 22. The pivoting portion 31 of the shackle 3 has a limiting annular groove 311. The embedded end 512 of the limiting member 5 is engaged with the limiting annular groove 311. The locking portion 32 has a locking annular groove 321. The locking end 42 of the locking member 4 is engaged with the locking annular groove 321. The shackle 3 may be a flexible steel rope.

Figure 2:
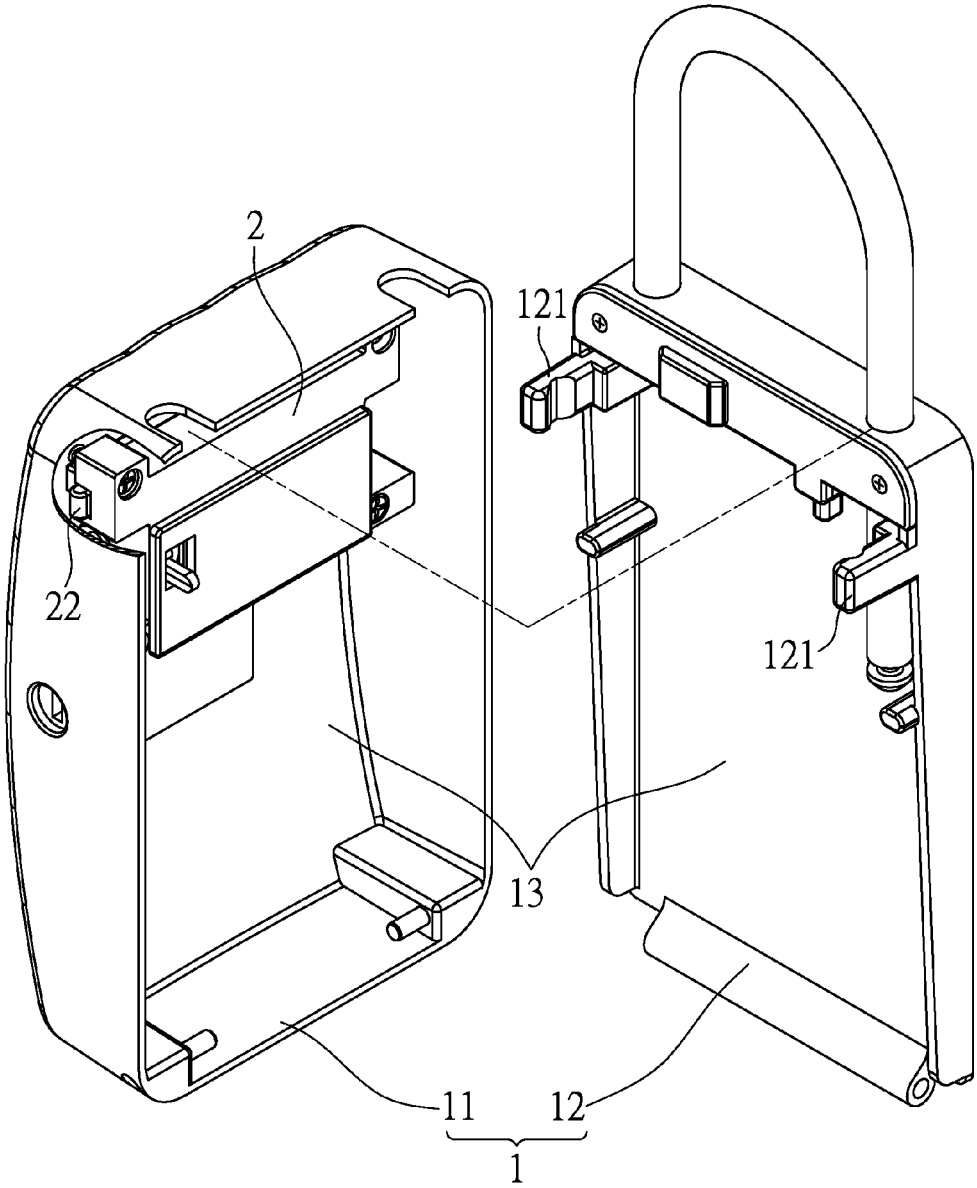
FIG. 2 is a perspective view of the padlock of the present invention while the front cover is opened.
Figure 3:
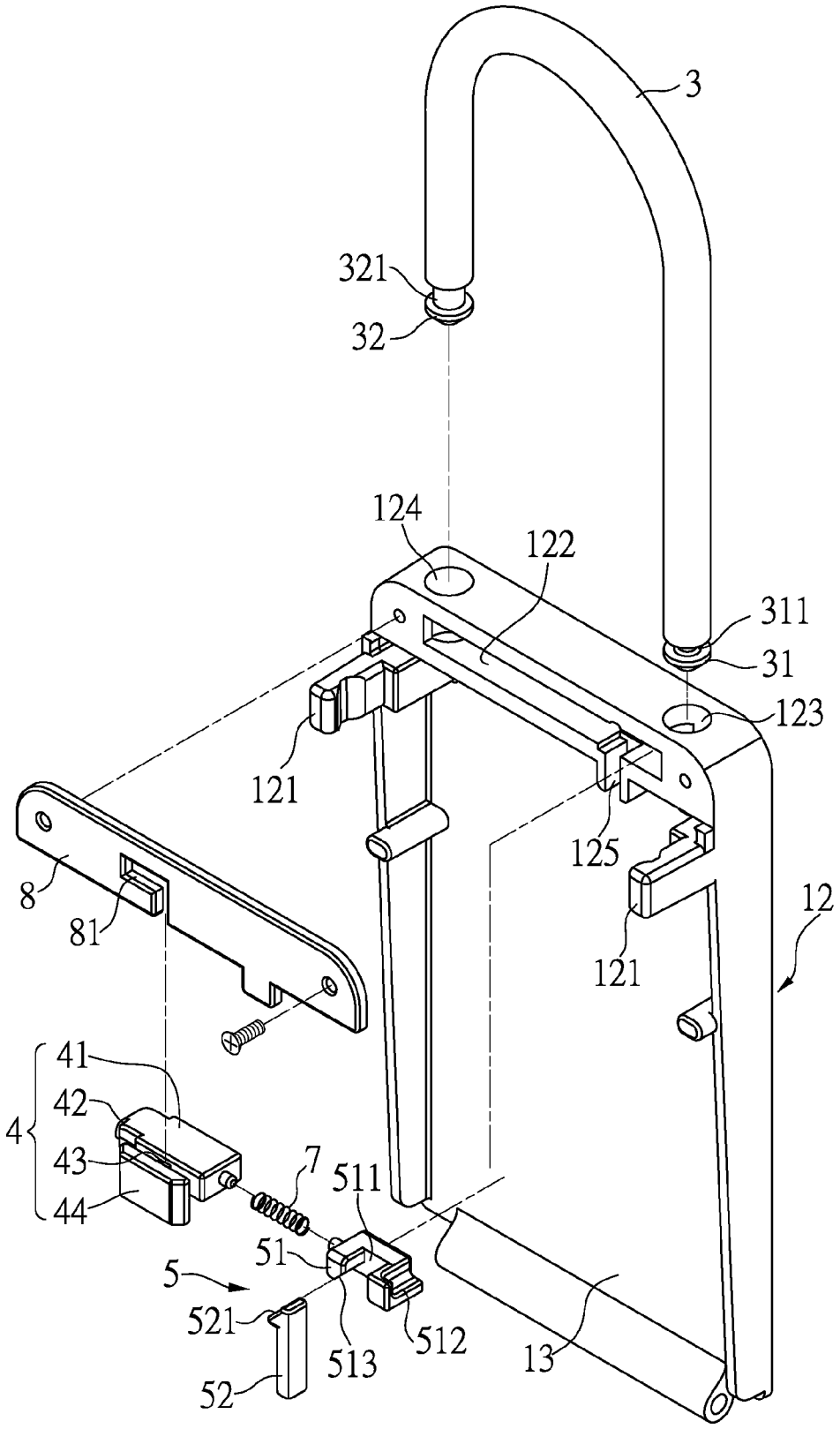
FIG. 3 is an exploded view of a rear cover of the padlock of the present invention.

According to above mentioned structure, the lock set 2, shown as in FIGS. 1 and 2, may be a combination lock set, but not limited thereto. When in operation, the locking set 2 which is arranged at the front cover 11 of the housing 1 must be unlocked first to make the block 22 separate from the arm 121. After the front cover 11 is pivoted and opened relative to the rear cover 12, the shackle 3 is ready to be unlocked.

Figure 4:
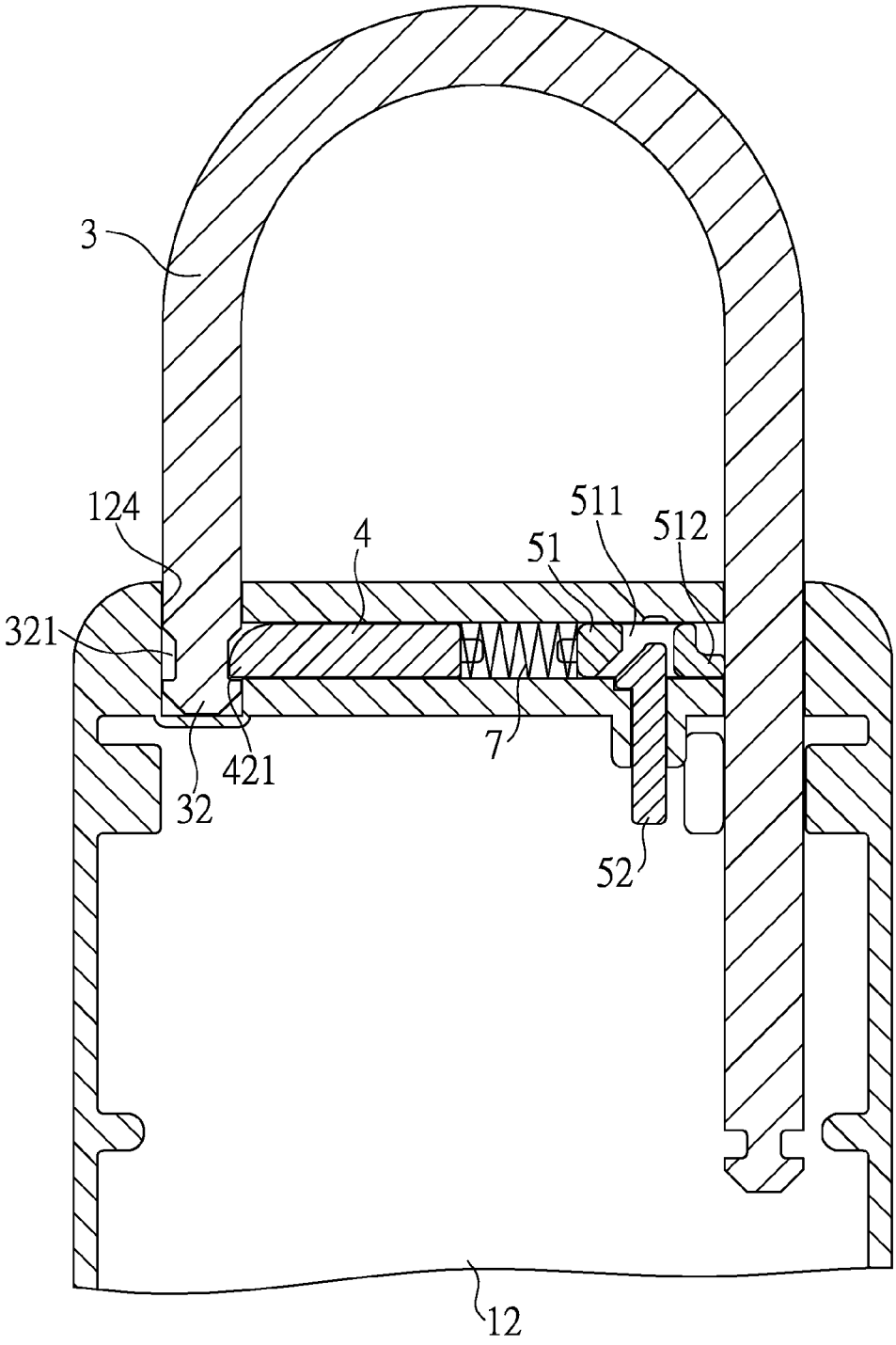
FIG. 4 is a cross-sectional view of a shackle of the padlock of the present invention while the shackle is locked.
Figure 5:
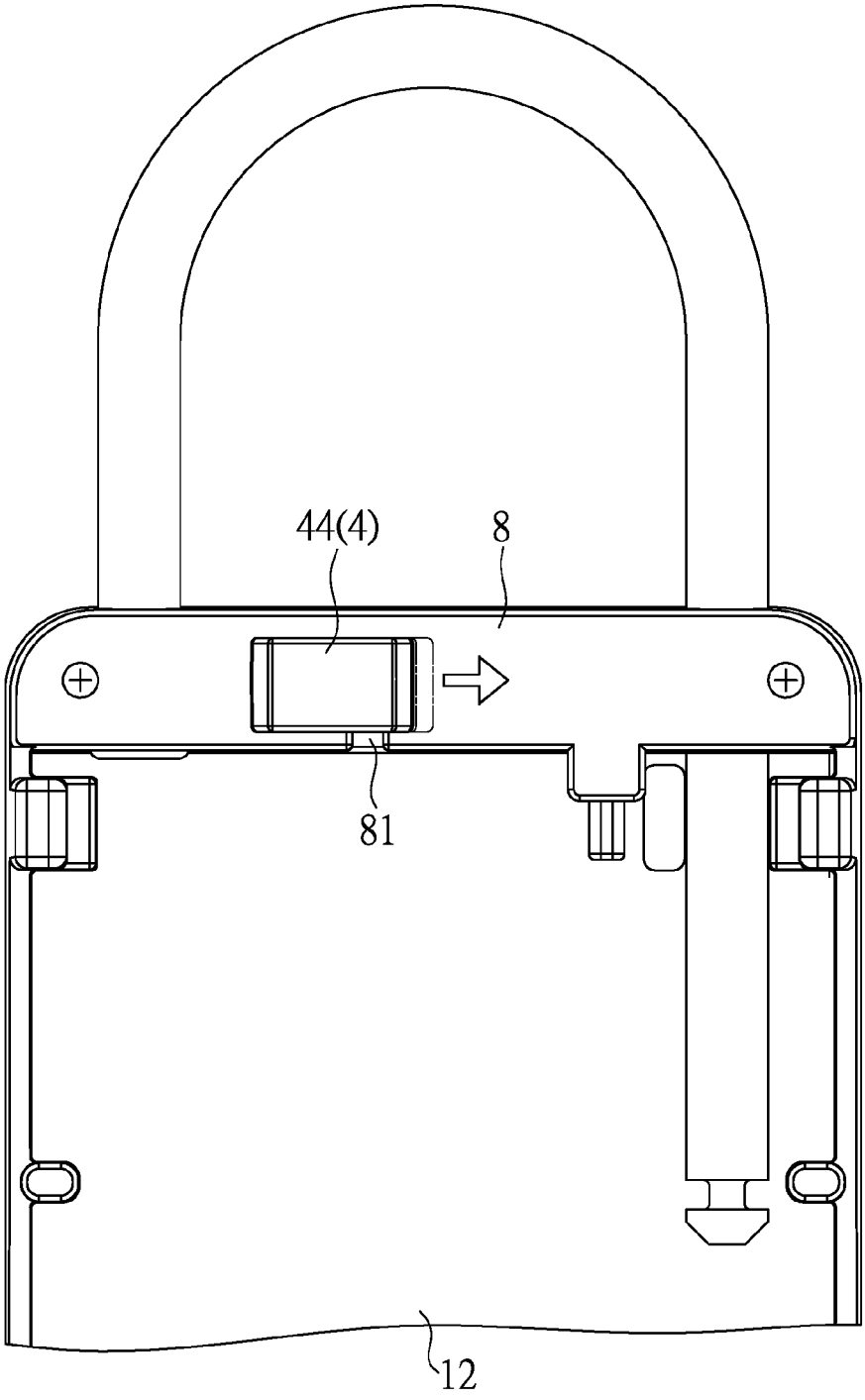
FIG. 5 is an operational view of the shackle of the padlock of the present invention while the shackle is unlocked.
Figure 6:
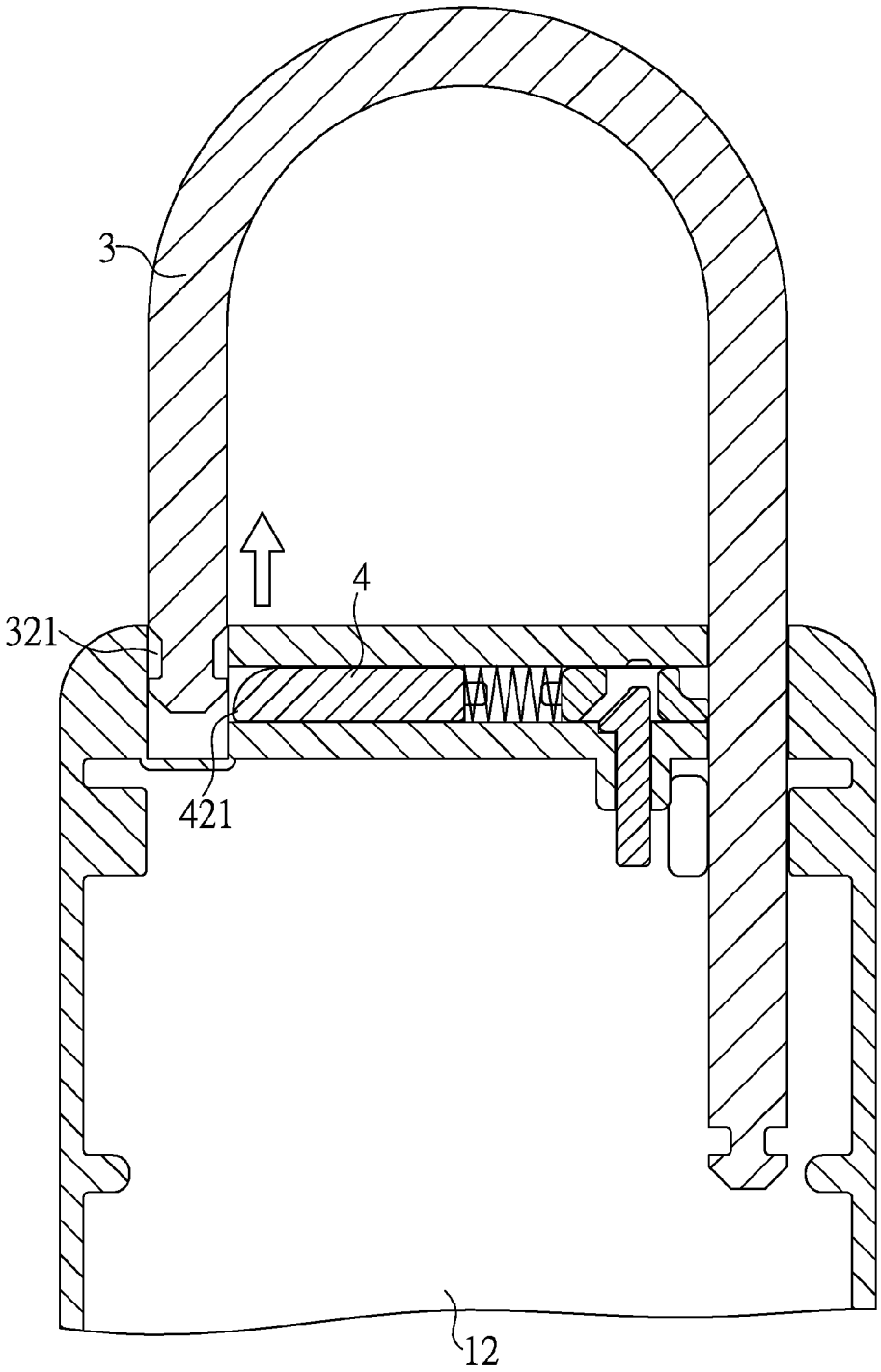
FIG. 6 is a cross-sectional view of the shackle of the padlock of the present invention while the shackle is unlocked.

Please refer to FIGS. 4 to 6. In FIG. 4, the locking end 42 of the locking member 4 is pushed to the locking hole 124 of the rear cover 12 and the locking annular groove 321 of the locking portion 32 which is inserted into the locking hole 124 is against and locked at the shackle 3 since two ends of the spring 7 are respectively against the locking member 4 and the limiting member 51. In FIG. 5, the locking member 4 is engaged within the limiting groove 81 of the covering plate 8 and the stirring portion 44 is exposed outside the limiting groove 81. When the stirring portion 44 is stirred along the direction of the arrow shown as in FIG. 5, the locking end 42 of the locking member 4 is disengaged with the locking annular groove 321 of the shackle 3 shown as in FIG. 6 and the shackle 3 may be pulled out along the direction of the arrow in FIG. 6.

Figure 7:
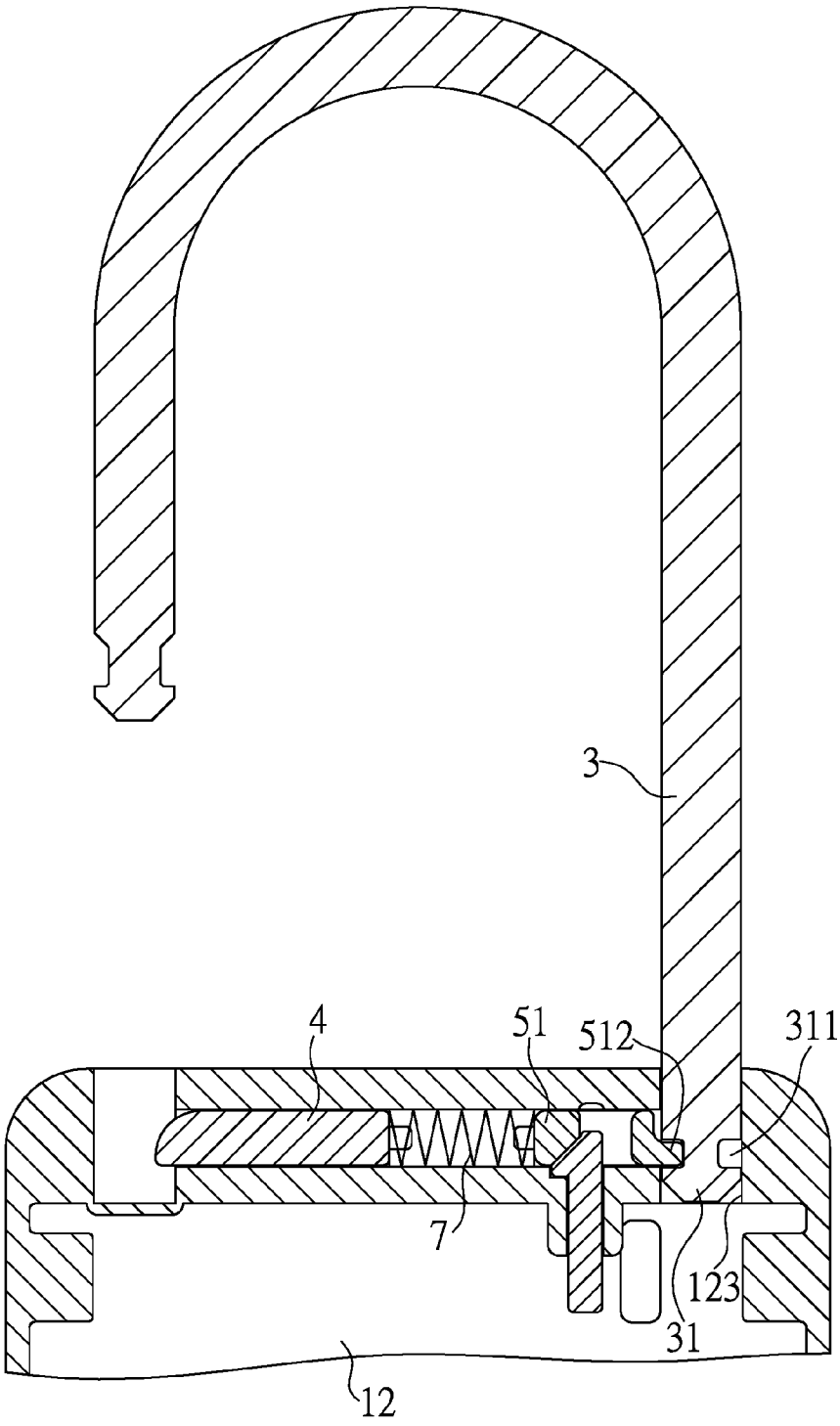
FIG. 7 is a cross-sectional view of the shackle of the padlock of the present invention while the shackle is limited.

FIG. 7 is a cross-sectional view of the shackle of the padlock of the present invention while the shackle is limited. Because two ends of the spring 7 are respectively against the locking member 4 and the limiting member 51, the embedded end 512 of the limiting member 51 is normally pushed into the through hole 123 of the rear cover 12 so that the embedded end 512 is pushed into the limiting annular groove 311 while the pivoting portion 31 of the shackle 3 is pulled out from the through hole 123. Therefore, the shackle 3 cannot separate from the rear cover 12 due the limitation assembly.

Figure 8:
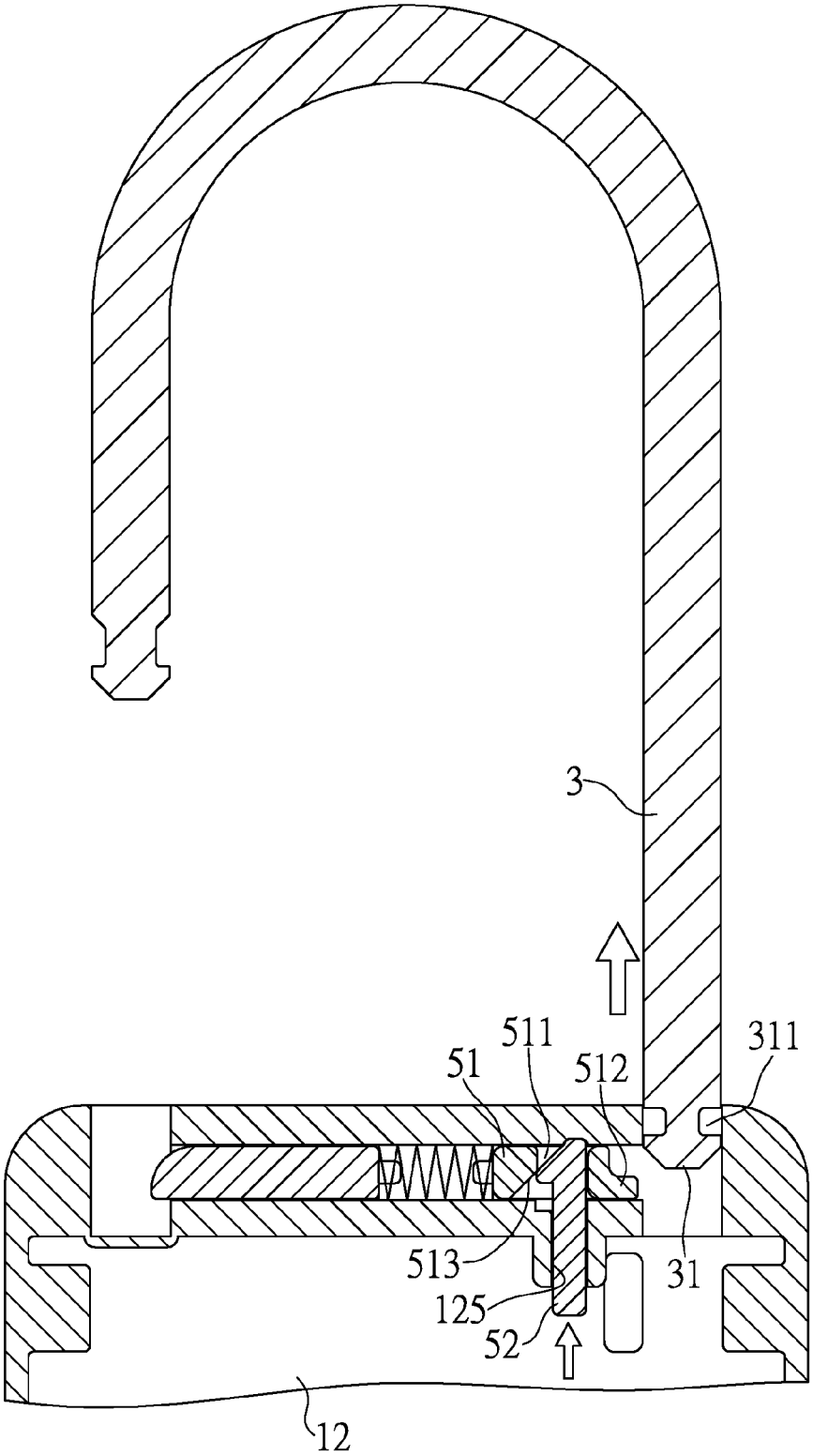
FIG. 8 is an operational view of the shackle of the padlock of the present invention while the shackle is released.
Figure 9:
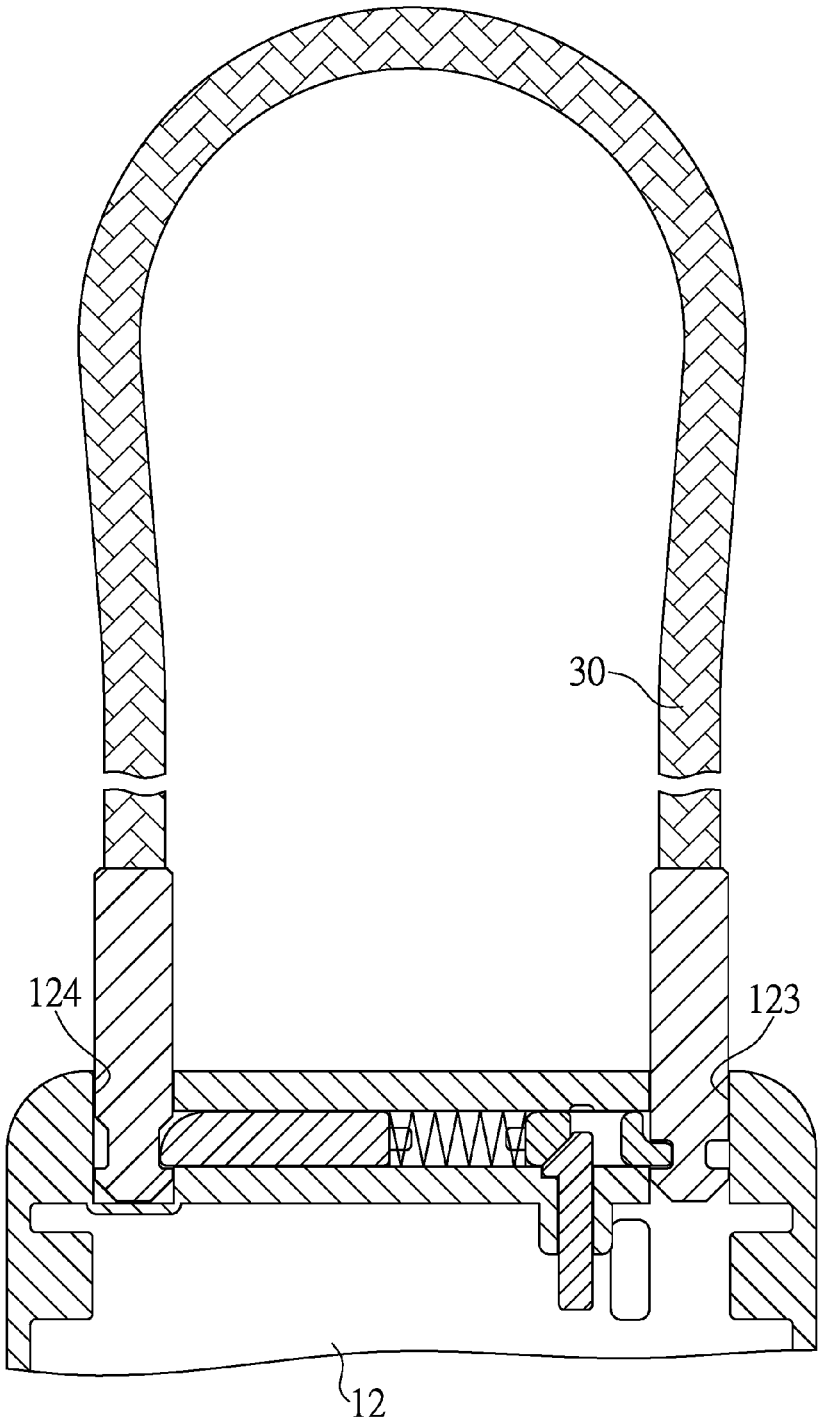
FIG. 9 is a cross-sectional view of the padlock of the present invention while replacing other different shackle.

FIG. 8 is an operational view of the shackle of the padlock of the present invention while the shackle is released. FIG. 9 is a cross-sectional view of the padlock of the present invention while replacing other different shackle. The releasing member 52 is slidably arranged at the penetrating groove 125 to insert into the entry slot 511 of the limiting member 51 and the pushing inclined plane 521 of the releasing member 52 is corresponding to the inclined surface 513 of the limiting member 51. When the releasing member 52 is pushed along the direction of the arrow shown as in FIG. 8, the pushing inclined plane 521 is contacted with the inclined surface 513 to push the limiting member 51. The embedded end 512 is separated from the limiting annular groove 311 to release the pivoting portion 31 of the shackle 3. The shackle 3 may be detached from the rear cover 12. In FIG. 9, another shackle 30 which has different size from the shackle 3 may be installed in the through hole 123 and the locking hole 124 of the rear cover 12. It shows that the padlock is capable for applying to the objects with various sizes.

The shackle 3 may be removable passing through and limited by the pivoting portion 31 of the rear cover 12 since the embedded end 512 is slidably arranged at one end of the limiting member 51 of the rear cover 12. The shackle 3 may be replaced with various sizes and capable for applying to the objects with various sizes. The consumers do not need to the shackles with different standards to cooperate with different objects to prevent from wasting money and further the padlock may be accepted by the consumers much more. And the applicability of the padlock with the removable shackle is much wider.

The foregoing descriptions are merely the exemplified embodiments of the present invention, where the scope of the claim of the present invention is not intended to be limited by the embodiments. Any equivalent embodiments or modifications without departing from the spirit and scope of the present invention are therefore intended to be embraced.

The disclosed structure of the invention has not appeared in the prior art and features efficacy better than the prior structure which is construed to be a novel and creative invention, thereby filing the present application herein subject to the patent law.

What is claimed is:

1. A padlock with a removable shackle, comprising:

a housing, having a front cover and a rear cover, the rear cover is pivoted at the front cover and capable for pivotably opening and closing relative to the front cover, a cavity is defined by the front cover and the rear cover while they are closed together, one side of the rear cover corresponding to the front cover has a sliding groove, an outer wall of one side of the rear cover corresponding to the sliding groove has a through hole and a locking hole which are communicated with the sliding groove, a penetrating groove is formed at a side wall of the sliding groove connected with the cavity and the penetrating groove is fluidly communicated with the sliding groove;

a shackle, having a pivoting portion and a locking portion connected with each other, the pivoting portion is passing through the through hole and moved toward the cavity, and the locking portion is separated from or locked at the housing through moving the pivoting portion;

a locking member, having a hook portion and a locking end, the locking member is slidably arranged in the sliding groove, and the locking end is limited by or separated from the locking portion of the shackle; and a limiting set, having a limiting member and a releasing member, the limiting member includes an entry slot, an embedded end, and an inclined surface, the inclined surface is connected with a side wall of the entry slot, the limiting member is slidably arranged in the sliding groove, the embedded end is limited by or separated from the pivoting portion of the shackle, a pushing inclined plane is arranged at the releasing member corresponding to the inclined surface, the releasing member is slidably arranged in the penetrating groove and inserted into the entry slot of the limiting member;

wherein the pushing inclined plane is against the inclined surface and then the limiting member is pushed by the pushing inclined plane to separate from or limit the pivoting portion.

2. The padlock as claimed in claim 1, further comprises a spring, the spring is located in the sliding groove and arranged between the locking member and the limiting member, and two ends of the spring are respectively against the locking member and the limiting member.

3. The padlock as claimed in claim 1, wherein the housing further has a covering plate, the sliding groove is covered by the covering plate, the covering plate has a limiting groove, one side of the locking member corresponding to an opening of the sliding groove has a neck portion and a stirring portion, the neck portion is engaged with the limiting groove, and the stirring portion is exposed outside the covering plate.

4. The padlock as claimed in claim 2, wherein the housing further has a covering plate, the sliding groove is covered by the covering plate, the covering plate has a limiting groove, one side of the locking member corresponding to an opening of the sliding groove has a neck portion and a stirring portion, the neck portion is engaged with the limiting groove, and the stirring portion is exposed outside the covering plate.

5. The padlock as claimed in claim 1, wherein the rear cover has at least one arm, a lock set is arranged at the front cover and located in the cavity, the lock set has at least one block corresponding to the arm, and the lock set controls the arm to lock or unlock the block.

6. The padlock as claimed in claim 1, wherein the pivoting portion of the shackle has a limiting annular groove, the embedded end of the limiting member is engaged with the limiting annular groove, the locking portion has a locking annular groove, and the locking end of the locking member is engaged with the locking annular groove.

7. The padlock as claimed in claim 1, wherein the shackle is a flexible steel rope.

8. The padlock as claimed in claim 6, wherein the shackle is a flexible steel rope.

* * * * *